United States Patent [19]

Weyn

[11] 3,935,974

[45] Feb. 3, 1976

[54] AEROSOL DISPENSING DEVICE WITH VENTURI

[75] Inventor: Hendrik Frans Weyn, Le Chesnay, France

[73] Assignee: Colgate-Palmolive Company, New York, N.Y.

[22] Filed: Nov. 18, 1974

[21] Appl. No.: 524,517

[30] Foreign Application Priority Data

Dec. 19, 1973 France ..... 73.45488

[52] U.S. Cl. ..... 222/402.13; 222/182; 239/288.5

[51] Int. Cl.[2] ..... B65D 83/00; B65D 83/06; B65D 83/14; B05B 1/28

[58] Field of Search ..... 222/402.13, 182; 239/288, 239/288.3, 288.5

[56] References Cited

UNITED STATES PATENTS

| | | | |
|---|---|---|---|
| 3,254,803 | 6/1966 | Meshberg | 222/182 |
| 3,330,447 | 7/1967 | Doblin | 222/402.13 |
| 3,377,005 | 4/1968 | Marder | 222/402.13 |
| 3,756,514 | 9/1973 | Brown | 239/288.5 |
| 3,792,802 | 2/1974 | Gores | 222/402.13 |
| 3,854,632 | 12/1974 | Smrt | 222/182 |

*Primary Examiner*—Lloyd L. King
*Attorney, Agent, or Firm*—Herbert S. Sylvester; Murray M. Grill; Norman Blumenkopf

[57] ABSTRACT

A spray confining aerosol dispensing device includes a pressurized aerosol container provided with an upwardly directed discharge tube coupled to a coaxial spray nozzle having a venturi shaped bore to effect the divergence of the spray. An axially movable spray confining tubular shield having an end discharge opening slightly greater than the spray pattern at such opening projects axially from the container, and axial depression of the shield effects the depression of the container valve actuator to open the valve. In one form the shield is alternatively movable to an extended operative position and to a contracted inoperative position with the container telescoping the shield and in another form the shield carries the venturi nozzle on a transverse wall so that the shield may be alternatively employed as a closure cap or a valve actuating spray confining shield.

7 Claims, 5 Drawing Figures

AEROSOL DISPENSING DEVICE WITH VENTURI

It is a principal object of the present invention to provide an improved spray device having a spray confining shield axially collapsible upon the device.

Another object of the present invention is to provide an improved aerosol spray device employing a pressurized aerosol container.

Still another object of the present invention is to provide an improved aerosol container spray device in which the spray is confined to a predetermined region.

A further object of the present invention is to provide an aerosol spray device of the above nature, characterized by its reliability, simplicity, ruggedness, low cost, convenience and great versatility and adaptability.

The above and other objects of the present invention will become apparent from a reading of the following description taken in conjunction with the accompanying drawings which illustrate preferred embodiments thereof.

In a sense, the present invention contemplates the provision of a spray device comprising an aerosol container including a normally closed valve and an axially directed discharge tube and an actuator coupled to the valve and movable between a valve open and a valve closed position, a tubular sleeve axially slideably engaging the container and projecting above the top thereof and terminating at its distal end as an applicator opening, a spray diverging nozzle having a venturi shaped bore coaxial and communicating with the discharge tube and means coupling the sleeve to the valve actuator so that the depression of the sleeve operates the actuator to open the valve.

According to a preferred form of the improved device as applied to an aerosol container provided with a main cylindrical wall having annular beads along its top and bottom edges, the valve actuator includes a pair of opposite radial arms projecting outwardly beyond the top bead. An inwardly directed peripheral bottom rib is formed on the bottom inside face of the sleeve and is movable with the raising and lowering of the sleeve into engagement with the top and bottom beads respectively, thereby limiting the axial movement of the sleeve. Extending upwardly from the bottom rib are a pair of short opposite ribs which extend peripherally about 90°, and located shortly above and peripherally and radially coextensive with the lower ribs are a pair of main ribs which extend to a point short of the upper edge of the sleeve. Another pair of relatively low ribs are located above and are radially and peripherally coextensive with the main ribs. The confronting end faces of the lower, main and top ribs delineate top and bottom 90° peripheral passages which alternatively engage the valve actuator arms to permit their depression or their locking in a raised position.

An alternate form of the improved spray device includes a cap having a transverse wall spaced between the ends of the cap peripheral wall which has inwardly facing peripheral channels of different widths at opposite ends thereof. When the wider channel engages the top peripheral bead of the container it permits axial movement of the cap. An axial venturi nozzle is centrally located on the cap transverse wall and engages the discharge tube and bears on the valve actuator when the cap wide channel engages the container bead so depression of the shield defining cap opens the spray valve. When inverted the shield functions as a closure cap.

The improved spray devices are simple and inexpensive, are easy and convenient to use and confine the aerosol spray to the desired area of application.

DESCRIPTION OF THE PREFERRED EMBODIMENTS

Figure 1:
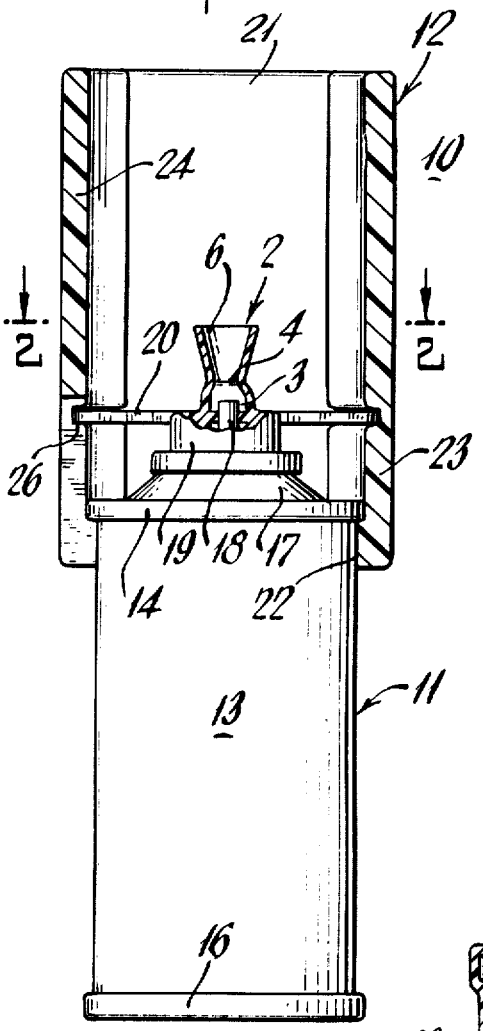
FIG. 1 is a front elevational view, partially in vertical medial section, of a preferred embodiment of the present invention.
Figure 2:
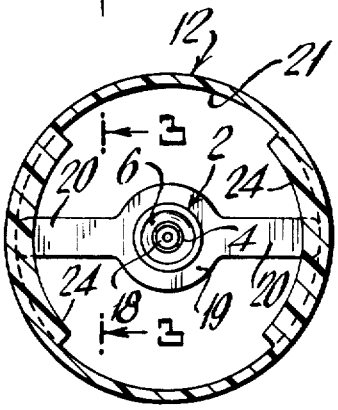
FIG. 2 is a sectional view taken along line 2—2 in FIG. 1.
Figure 3:
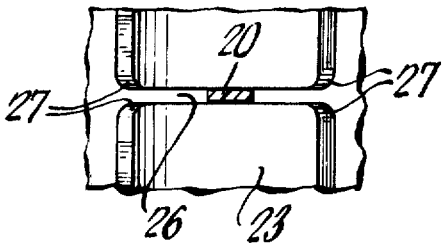
FIG. 3 is a sectional view taken along line 3—3 in FIG. 2.

Referring now to the drawings, particularly FIGS. 1 to 3 thereof which illustrate a preferred embodiment of the present invention, the reference numeral 10 generally designates the improved aerosol spray device which includes a pressurized aerosol spray container 11 and a valve actuator depressor and spray confining shield sleeve 12. The aerosol container 11 is of conventional construction and includes a main cylindrical wall 13 provided at its top and bottom edges with overhanging peripheral top and bottom beads 14 and 16 respectively.

The container 11 is provided with a domed top wall 17 on which is located a coaxial upwardly directed spray nozzle 18 which communicates with the bottom of container 11 through a normally closed valve which is opened with the depression of a valve actuator 19 provided with a pair of opposite radial arms 20 which project outwardly a short distance beyond the peripheral bead 14. The container 11 is loaded with a volatile propellant such as a Freon having uniformly admixed therewith any desirable composition, for example, an anti-perspirant or deodorant.

The sleeve member 12 is integrally formed as a unit of any suitable material, such as a synthetic organic polymeric resin, for example, polyethylene, polypropylene, polyvinyl chloride or the like, and includes a thin cylindrical outer wall 21 having an inside diameter greater than the outside diameter of peripheral bead 14. Projecting inwardly along the lower border of sleeve wall 21 and in sliding engagement with container wall 13, is an integrally formed peripheral rib or collar 22 having an annular upper shoulder which engages the lower face of bead 14 when sleeve 12 is in its raised extended position and an annular bottom shoulder which engages the top face of bottom bead 16 when the sleeve 12 is in its lowered contracted position. The collar 22 and the corresponding lower border of wall 21 are advantageously provided with peripherally spaced vertical slits to facilitate the assembly of the container 11 and sleeve member 12.

Extending above the collar 22 and projecting inwardly from wall 21 are a pair of diametrically opposite ribs or projections 23 each of which extends peripherally for about 90° and whose adjacent ends are spaced about 90°. The distance between the top faces of ribs 23 and collar 22 is about equal to the distance between the underfaces of actuator arms 20 and upper bead 14 and the inside diameter of ribs 23 is slightly larger than the outside diameter of bead 14.

A pair of diametrically opposed 90° peripherally extending ribs 24 are located above ribs 23 and are peripherally and radially coextensive therewith and extend to points a short distance below the top edge of wall 21. The confronting end faces of registering ribs 23 and 24 delineate peripheral tracks or passageways 26 and the corners of these faces are rounded, as at 27, to provide converging guide faces into the passageways 26. It should be noted, that while the upper edge of sleeve member 12 is illustrated as being planar, it may be undulate to mate the corresponding contour of the axilla.

In order to effect a spray of optimum pattern, that is, a spray which diverges to approximately the shield exposed area to be treated, a spray diverging venturi nozzle 2 is coaxially positioned atop the valve actuator 19 and may be integrally formed therewith. The nozzle 2 is provided with a venturi shaped axial bore including an enlarged portion 3 which is in coaxial registry and friction fit to valve stem 18, a restricting intermediate passageway 4, and an outer enlarged outlet section 6, the inlet section 3 intermediate restricted passageway 4 and the outlet section 6 are advantageously successively joined by smoothly curved converging and diverging bore faces respectively. The friction fit between the actuator and valve stem 18 may entirely encircle the valve stem or, as shown, may leave an opening for drawing in air.

In employing the spray device 10, the device 10 is held by pressing the container 11, with the upper edge of sleeve member 12 in its extended position as shown in FIG. 1, against the axilla with sufficient pressure to depress the actuator arms 20 and open the spray valve. An aerosol spray is thus axially emitted from the nozzle 18 and is confined by the shield sleeve 12 to impinge in the area delineated by the upper edge of the sleeve 12 and to thereby eliminate or minimize any overspray.

By reason of the spray effecting and control characteristics of the nozzle 2, the aerolsol spray at the outlet applicator opening of sleeve shield 12 covers an area corresponding to or slightly less than the area of the opening in the plane of the opening.

In storing the device 10 it is contracted by twisting the sleeve 12 relative to the container 11 until the arms 20 are out of engagement with the passageways 26 and the sleeve 12 is then depressed to its contracted position with the collar 22 abutting the bottom bead 16. The sleeve 12 may then be turned to bring the arms 20 into engagement with passageways 29 and thereby lock the actuator arms 20 against depression. The device 10 may be extended for use in the above manner by reversing the contraction procedure.

Figure 4:
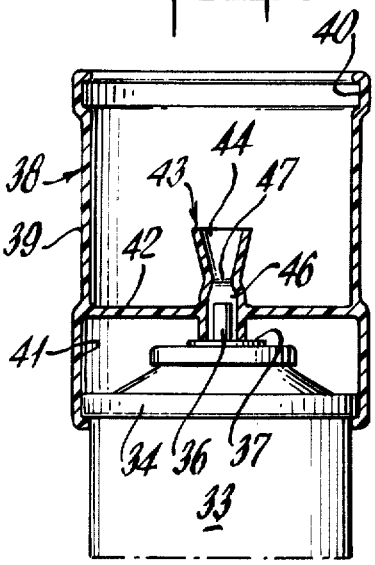
FIG. 4 is a fragmentary elevational view, partially in section, of another embodiment of the present invention shown in an operative condition.
Figure 5:
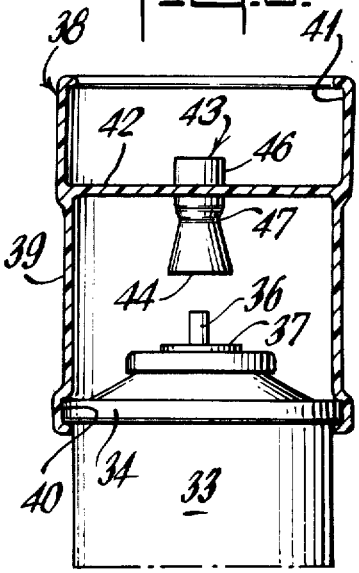
FIG. 5 is a view similar to FIG. 4 but shown in an inoperative condition.

Referring now to FIGS. 4 and 5 of the drawing which illustrate another embodiment of the present invention, the reference numeral 33 designates a pressurized aerosol spray container of conventional construction provided with an upper outwardly directed peripheral bead 34. An outlet or discharge tube 36 projects axially upwardly from the container 33 and communicates with the contents thereof by way of a normally closed valve which is opened by the depression of a circular cap shaped valve actuator 37 which is coaxial with and a short distance below the top of discharge tube 36.

A shield member 38 includes a cylindrical sleeve or walls 39 of approximately the diameter of container 33 and formed along its upper border, when in an operative condition, an inwardly concave peripheral channel 40 adapted, when invented, to substantially mate the outer face of bead 34 and being adapted to releasably snap engage the bead 34. A relatively wide, peripherally extending, inwardly open channel 41, wider than the thickness of bead 34, is formed in the opposite end of sleeve 39 and is likewise adapted to releasably engage bead 34 while permitting the axial movement of sleeve 39 on the container 33.

A transverse wall 42 is positioned in and preferably integrally formed with sleeve 39 and has a central opening formed therein. A nozzle 43, similar in construction to the nozzle 2 of the first described embodiment, coaxially engages the opening in wall 42 and is firmly affixed therein and projects to opposite sides of the transverse wall 42. Like the nozzle 2, the nozzle 43 has a venturi shaped axial bore, including an outwardly diverging outlet section 44, an outwardly diverging inlet section 46 and a restricted intermediate section 47. The axial distance between the outer end edge of channel 41 and the proximate end edge of nozzle 43 is about equal to or slightly greater than the axial distance between the top face of actuator 37 and the underface of bead 34, so that when the shield 38 is in its operative mounted position on container 33 with channel 41 engaging bead 34, as shown in FIG. 4, the end face of nozzle 43 engages, but does not depress, valve actuator 37. Depression of the shield 38 for the width of channel 41, or somewhat less, depresses actuator 37 sufficiently to open the spray valve.

The operation and application of the device last described, when the shield 38 is in its operative condition as shown in FIG. 4, is similar to the first described embodiment. In the event it is desired to store the device while preventing actuating of the spray valve, the shield 38 with its assembled components, is detached and separated from the container 33, inverted and reapplied to the container 33 (as shown in FIG. 5) with the channel 40 snap engaging the bead 34. In the latter condition, the nozzle 43 is spaced above actuator 37 and is prevented from bearing thereon.

While there have been described and illustrated preferred embodiments of the present invention, it is apparent that numerous alterations, additions and omissions may be made without departing from the spirit thereof.

I claim:

1. A spray device comprising an aerosol container including a normally closed valve and an axially directed discharge tube and an actuator coupled to said valve and movable between a valve open and a valve closed position, a tubular sleeve axially slideably engaging said container and projecting above the top thereof and terminating at its distal end in an opening a spray expanding nozzle having a venturi shaped bore coaxial and communicating with said discharge tube, means coupling said sleeve to said actuator whereby depression of said sleeve operates said actuator to open said valve, said sleeve being axially movable between a raised extended position projecting above said container and a lowered contracted position telescoped by said container and including an actuator member transversely outwardly directed from said valve actuator, said coupling means comprising an actuator depressor section located on and movable with said sleeve between a raised position with the extended position of said sleeve to release said actuator member to its valve open position and a depressed position urging said actuator member to a valve open position with the depression of said sleeve below its extended position.

2. A spray device comprising an aerosol container including a normally closed valve and an axially directed discharge tube and an actuator coupled to said valve and moveable between a valve open and a valve closed position, a tubular sleeve axially slideably engaging said container and projecting above the top thereof and terminating at its distal end in an opening, a spray expanding nozzle having a venturi shaped bore coaxial and communicating with said discharge tube, means coupling said sleeve to said actuator whereby depression of said sleeve operates said actuator to open said valve, said sleeve being axially movable between a raised extended position projecting above said container and a lowered contracted position telescoped by said container and including an actuator member transversely outwardly directed from said valve actuator, said coupling means comprising an actuator depressor section located on and movable with said sleeve between a raised position with the extended position of said sleeve to release said actuator member to its valve open position and a depressed position urging said actuator member to a valve open position with the depression of said sleeve below its extended position, said sleeve being rotatable relative to said container and said actuator depressor section being rotatable with said sleeve into and out of engageable registry with said actuator member.

3. A spray device comprising an aerosol container including a normally closed valve and an axially directed discharge tube and an actuator coupled to said valve and movable between a valve open and a valve closed position, a tubular sleeve axially slideably engaging said container and projecting above the top thereof and terminating at its distal end in an opening a spray expanding nozzle having a venturi shaped bore coaxial and communicating with said discharge tube, means coupling said sleeve to said actuator whereby depression of said sleeve operates said actuator to open said valve, said sleeve being axially movable between a raised extended position projecting above said container and a lowered contracted position telescoped by said container and including an actuator member transversely outwardly directed from said valve actuator, said coupling means comprising an actuator depressor section located on and movable with said sleeve between a raised position with the extended position of said sleeve to release said actuator member to its valve open position and a depressed position urging said actuator member to a valve open position with the depression of said sleeve below its extended position, said valve actuator member comprises an arm projecting radially beyond the periphery of said container and said actuator depressor section includes an inwardly directed shoulder member positioned on the lower inner border of said sleeve and projecting to a point between the outer periphery of said container and the outer end of said actuator arm, said shoulder member extending for less than the full periphery of said sleeve.

4. A spray device comprising an aerosol container including a normally closed valve and an axially directed discharge tube and an actuator coupled to said valve and movable between a valve open and a valve closed position, a tubular sleeve axially slideably engaging said container and projecting above the top thereof and terminating at its distal end in an opening, a spray expanding nozzle having a venturi shaped bore coaxial and communicating with said discharge tube, means coupling said sleeve to said actuator whereby depression of said sleeve operates said actuator to open said valve, said sleeve being axially movable between a raised extended position projecting above said container and a lowered contracted position telescoped by said container and including an actuator member transversely outwardly directed from said valve actuator, said coupling means comprising an actuator depressor section located on and movable with said sleeve between a raised position with the extended positon of said sleeve to release said actuator member to its valve open position and a depressed position urging said actuator member to a valve open position with the depression of said sleeve below its extended position, a transverse wall extending across and secured to said sleeve at a level spaced from a first end of said sleeve, said container having an outwardly directed peripheral bead along its upper edge, said sleeve having a peripherally extending inwardly open channel proximate said first end releasably engaging said bead for axial movement relative thereto, said spray nozzle being centrally supported by and projecting through said transverse wall and releasably axially engaging said discharge tube.

5. The device of claim 4, including an axially bored cap mounted atop said discharge tube and axially releasably engaged by said discharge nozzle bore.

6. The device of claim 4, wherein the end of said sleeve opposite said first end has a peripherally extending channel formed therein whereby said sleeve may be separated from said container reversed and applied to said container as a closure cap.

7. The device of claim 4, wherein said transverse wall is positioned intermediate the ends of said sleeve.

* * * * *